US011302498B1

(12) United States Patent
Piper

(10) Patent No.: US 11,302,498 B1
(45) Date of Patent: Apr. 12, 2022

(54) HANDLE ASSEMBLY

(71) Applicant: ABB Schweiz AG, Baden (CH)

(72) Inventor: Chuck Piper, Burlington, NC (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/031,969

(22) Filed: Sep. 25, 2020

(51) Int. Cl.

| | |
|---|---|
| ***H01H 21/22*** | (2006.01) |
| ***G05G 1/04*** | (2006.01) |
| ***H01H 21/36*** | (2006.01) |
| ***H01H 21/04*** | (2006.01) |
| ***G05G 25/04*** | (2006.01) |

(52) U.S. Cl.
CPC ..... *H01H 21/22* (2013.01); *G05G 1/04* (2013.01); *G05G 25/04* (2013.01); *H01H 21/04* (2013.01); *H01H 21/36* (2013.01); *G05G 2700/14* (2013.01)

(58) Field of Classification Search
CPC ..... H01H 21/22; H01H 21/04; G05G 1/04; G05G 25/04
USPC ..... 200/293
See application file for complete search history.

(56) References Cited

U.S. PATENT DOCUMENTS

| | | | | |
|---|---|---|---|---|
| 2,829,222 | A * | 4/1958 | Dunham | H01H 71/521 200/304 |
| 3,211,877 | A | 10/1965 | Walker et al. | |
| 3,319,035 | A | 5/1967 | Gelzheiser | |
| 3,475,710 | A | 10/1969 | Ellsworth et al. | |
| 3,780,249 | A | 12/1973 | Harper | |
| 6,008,458 | A | 12/1999 | Domzalski et al. | |
| 6,762,662 | B2 | 7/2004 | Lee et al. | |
| 2011/0272259 | A1 * | 11/2011 | Scola | H01H 71/525 200/293 |

FOREIGN PATENT DOCUMENTS

| | | | |
|---|---|---|---|
| DE | 10249169 | B4 | 10/2007 |

* cited by examiner

*Primary Examiner* — Edwin A. Leon
*Assistant Examiner* — Iman Malakooti
(74) *Attorney, Agent, or Firm* — Armstrong Teasdale LLP

(57) ABSTRACT

Handle assemblies for circuit breakers are disclosed. One illustrative handle assembly includes a housing defining a first aperture, a seal extending around a perimeter of the first aperture, a handle extending outwardly through the first aperture and pivotable about a pivot axis located within the housing, a shroud coupled to the handle to move therewith and located at least partially within the housing, and a biasing member connected to the handle and to the shroud. The shroud includes an outer surface that faces the seal, and the biasing member biases the outer surface into continuous engagement with the seal throughout an entire pivotable range of the handle.

20 Claims, 9 Drawing Sheets

HANDLE ASSEMBLY

TECHNICAL FIELD

The present disclosure relates to handle assemblies for circuit breakers.

BACKGROUND

Current limiting circuit breakers typically include a manual operating handle configured to switch the circuit breaker between on, off, and trip states. Typically, a portion of the handle extends out of the circuit breaker case or housing for manual operation of the circuit breaker. However, it is common for undesirable products, such as dust, water, and other contaminants, to enter the circuit breaker through gaps formed between the manually operable handle and the opening in the circuit breaker case or housing through which the handle projects. The enclosures of certain circuit breakers, such as UL50E Type 12 enclosures, must be constructed to meet governing body mandated standards. These standards include certain requirements regarding prevention of dust, water spray, and other such contaminants from entering the circuit breaker enclosure via, for example, the handle opening.

SUMMARY

According to one aspect of the present disclosure, a handle assembly may comprise a housing defining a first aperture, a seal extending around a perimeter of the first aperture, a handle extending outwardly through the first aperture and pivotable about a pivot axis located within the housing, a shroud coupled to the handle to move therewith and located at least partially within the housing, the shroud including an outer surface that faces the seal, and a biasing member connected to the handle and to the shroud, the biasing member biasing the outer surface into continuous engagement with the seal throughout an entire pivotable range of the handle.

In some embodiments, the handle may comprise a handle arm arranged at least partially within the housing, the handle arm having a first end coupled to the housing at a pivot point located on the pivot axis and a second end located opposite the first end, and a manually operable outer handle portion arranged on the second end of the handle arm.

In some embodiments, the shroud may be arranged on the handle arm and slidable along a longitudinal extent of the handle arm. The biasing member may be arranged within the outer handle portion and coupled to the shroud to bias the shroud toward the outer handle portion.

In some embodiments, the second end of the handle arm may be arranged outside of the housing. The shroud may be arranged on the handle arm such that at least a portion of the shroud protrudes out of the first aperture.

In some embodiments, the outer surface of the shroud may have an arcuate shape. A circumferential extent of the outer surface may be located partially within the housing.

In some embodiments, the arcuate shape of the outer surface may be concentric with the pivot axis. The outer surface may include a first circumferential portion and a second circumferential portion extending in opposite directions away from the handle arm. The first circumferential portion and the second circumferential portion may be symmetrical.

In some embodiments, the outer surface may have a curved cross-sectional shape. The seal may include a first side wall, a second side wall, a first end wall, and a second end wall each projecting inwardly toward the outer surface. The first side wall and the second side wall may each include an inner side wall edge that has the same contour as the arcuate shape of the outer surface. The first end wall and the second end wall may each include an inner end wall edge that has the same contour as the curved cross-sectional shape of the outer surface. The inner side wall edges of the first and second side walls as well as the inner end wall edges of the first and second end walls may define an inner sealing edge that engages the outer surface of the shroud.

In some embodiments, the outer handle portion may be hollow, and the biasing member may be disposed entirely within the outer handle portion. A first end of the biasing member may be coupled to a top portion of the outer handle portion, and a second end of the biasing member may be coupled to a top portion of the seal. The biasing member may be a pressure spring.

In some embodiments, the shroud may include a central hole through which the handle arm extends to allow the shroud to slide along the handle arm.

According to another aspect of the present disclosure, a circuit breaker comprise a circuit breaker case, at least two electrical terminals configured to automatically separate when an overload of current occurs at the at least two electrical terminals, and a handle assembly arranged at least partially within the circuit breaker case and including a handle configured to manually operate the at least two electrical terminals. The handle assembly may comprise a housing defining a first aperture, the housing having seal extending around a perimeter of the first aperture, the handle extending outwardly through the first aperture and pivotable about a pivot axis located within the housing, a pivotable range of the handle being delimited by the first aperture. The handle assembly may further comprise a shroud coupled to the handle to move therewith and located partially within the housing, the shroud including an outer surface that faces the seal. handle assembly may also comprise a biasing member connected to the handle and to the shroud, the biasing member biasing the outer surface into continuous engagement with the seal throughout the entirety of the pivotable range of the handle.

In some embodiments, the handle may comprise a handle arm arranged at least partially within the housing and having a first end coupled to the housing at a pivot point located on the pivot axis and a second end located opposite the first end. The handle may further comprise a manually operable outer handle portion arranged on the second end of the handle arm.

In some embodiments, the shroud may be arranged on the handle arm and slidable along a longitudinal extent of the handle arm. The biasing member may be arranged within the outer handle portion and coupled to the shroud to bias the shroud toward the outer handle portion. The shroud may be arranged on the handle arm such that at least a portion of the shroud protrudes out of the first aperture.

In some embodiments, the outer surface of the shroud may be arcuate. A circumferential extent of the outer surface may be located partially within the housing.

In some embodiments, the arcuate outer surface may be concentric with the pivot axis. The outer surface may include a first circumferential portion and a second circumferential portion extending in opposite directions away from the handle arm.

In some embodiments, the outer handle portion may be hollow, and the biasing member may be disposed entirely within the outer handle portion. A first end of the biasing member may be coupled to a top portion of the outer handle portion, and a second end of the biasing member may be coupled to a top portion of the shroud.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, the same reference labels or similar reference labels (e.g., reference labels ending in the same two digits) have been repeated among the figures to indicate corresponding or analogous elements. The detailed description particularly refers to the accompanying figures in which.

DETAILED DESCRIPTION OF THE DRAWINGS

Figure 1:
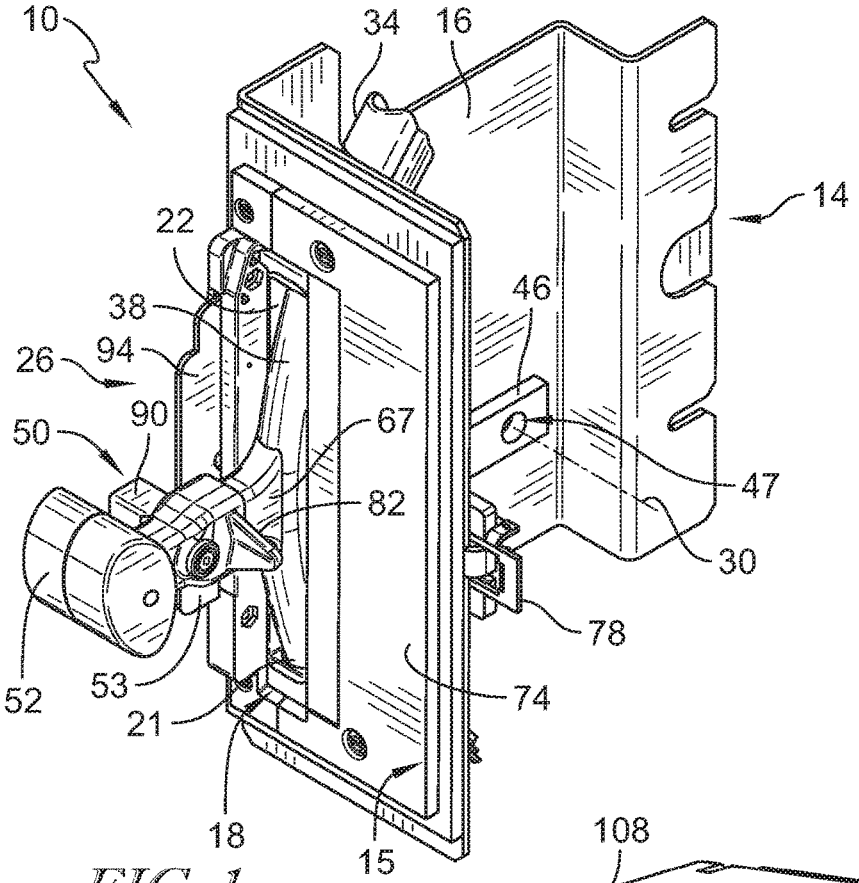
FIG. 1 is a isometric view of a handle assembly according to one illustrative embodiment.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but, on the contrary, the intention is to cover all modifications, equivalents, and alternatives falling within the spirit and scope of the invention as defined by the appended claims.

In the following description, numerous specific details, such as types and interrelationships of circuit components, are set forth in order to provide a more thorough understanding of the present disclosure. It will be appreciated, however, by one skilled in the art that embodiments of the disclosure may be practiced without such specific details. In other instances, various circuit components have not been shown in detail (or not labeled in every instance) in order to not obscure the invention. Those of ordinary skill in the art, with the included descriptions, will be able to implement appropriate functionality without undue experimentation.

References in the specification to "one embodiment," "an embodiment," "an illustrative embodiment," etcetera, indicate that at least one embodiment described may include a particular feature, structure, or characteristic, but not every embodiment necessarily includes the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

A handle assembly 10 that may be used in a circuit breaker 100 and includes a housing 14, a handle 26, a shroud 34 arranged on the handle 26, and a biasing member 42 is shown in FIGS. 1-5, 8, and 10. In the illustrative embodiment, the handle 26 is pivotable around a pivot axis located within the housing 14 and extends outwardly through a first aperture 18 formed in a front side of the housing 14. The shroud 34 is coupled to the handle 26 to move with the handle 26. In order to prevent dust, water spray, and other contaminants from entering the interior of the housing 14 and the circuit breaker 100, a seal 22 is housed by the escutcheon 74 and arranged to interface with and continuously engage the shroud 34 of the handle 26. Specifically, the shroud 34 is configured to continuously engage an inner sealing edge 21 of the seal 22 throughout the entirety of a pivotable range of the handle 26. In the exemplary embodiment, the seal 22 includes an inner sealing edge 21 and extends around a perimeter of the first aperture 18.

Figure 4:
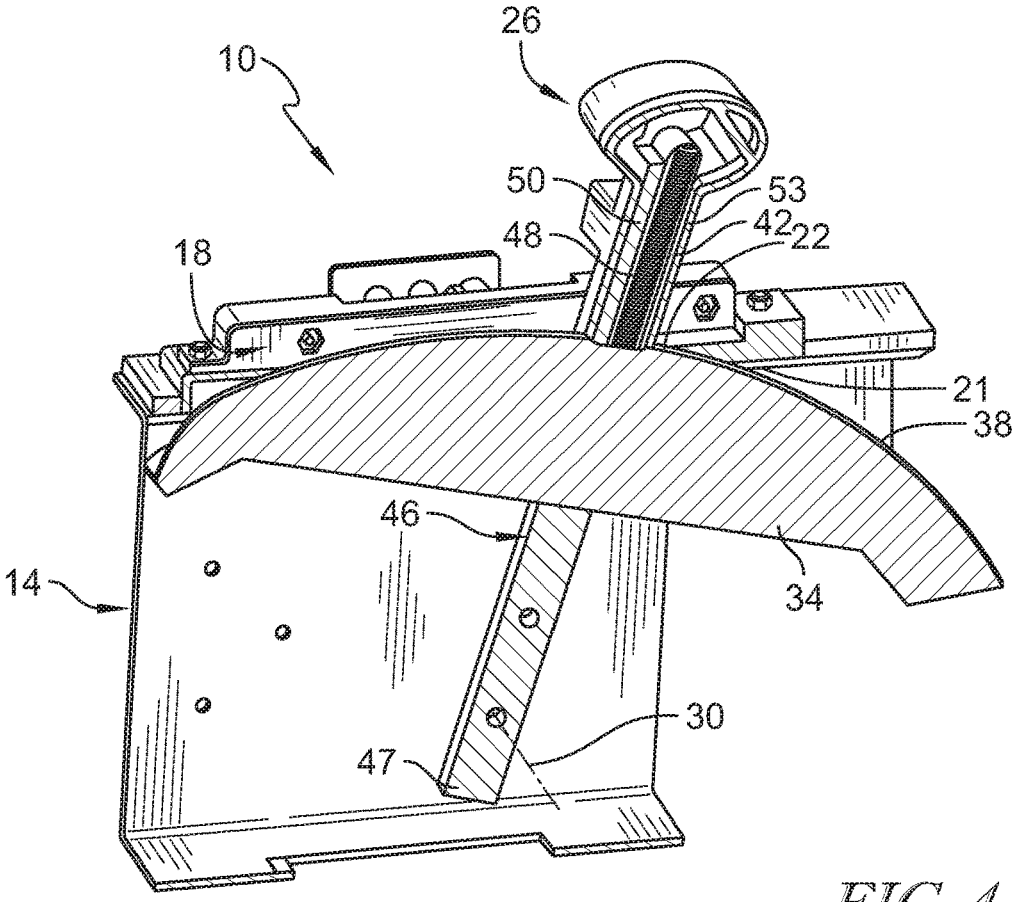
FIG. 4 is a cross-sectional view of the handle assembly of FIG. 1.

The shroud 34, in particular an outer surface 38 of the shroud 34, is biased into continuous engagement with the inner sealing edge 21 of the seal 22 via a biasing member 42, as shown in FIG. 4. The biasing member 42 is connected to the handle 26 and to the shroud 34 and exerts a pulling force on both the handle 26 and the shroud 34 such that shroud 34 is biased outwardly. As a result, the outer surface 38 is biased outwardly, or in other words, toward the seal 22 such that the outer surface 38 continuously contacts the inner sealing edge 21 of the seal 22 throughout the entire pivotable range of the handle 26.

Figure 2:
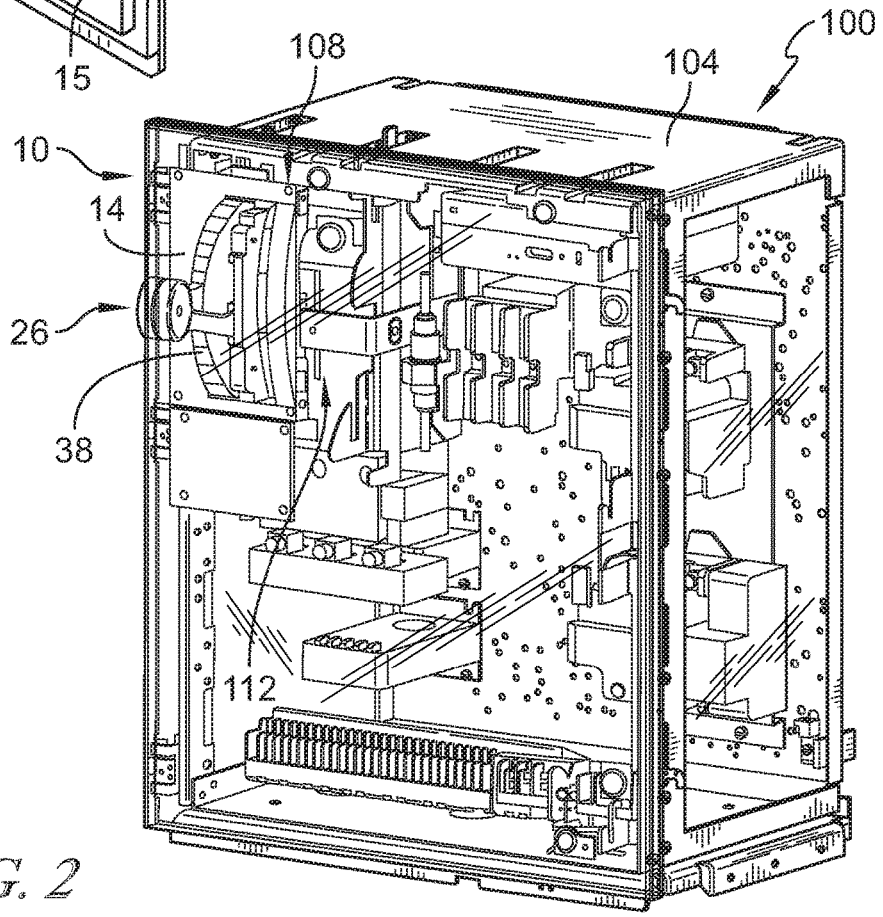
FIG. 2 is a front perspective view of the handle assembly of FIG. 1 showing the handle assembly included in a circuit breaker.

The handle assembly 10 is adapted for use in a circuit breaker 100 as shown in FIG. 2. The circuit breaker 100 may be any conventional circuit breaker configured to protect a circuit or circuits from an overload, a short circuit, a ground fault, or the like. For example, the handle assembly 10 may be utilized in a UL Type 50 (NEMA) type electrical enclosure. UL 50 (NEMA) enclosure ratings determine how well the enclosures of electronic components resist the infiltration of dust and moisture. In particular, UL50 Type 12 enclosures are constructed for indoor use to provide a degree of protection to personnel against access to hazardous parts, to provide a degree of protection of the equipment inside the enclosure against ingress of solid foreign objects (falling dirt and circulating dust, lint, fibers, and flyings) and to provide a degree of protection with respect to harmful effects on the equipment due to the ingress of water (dripping and light splashing). (NEMA 250-2003.) The handle assembly 10 may be adapted to be used specifically with UL50E Type 12 circuit breakers.

As shown in FIG. 2, the circuit breaker 100 includes an enclosure 104, an opening 108 formed in a side wall of the enclosure 104, and at least two electrical terminals 112. The enclosure 104, which may be comprised of plastic, metal, or other conventional materials, is houses the electronic components of the circuit breaker 100, including the two electrical terminals 112, as well as the handle assembly 10. The opening 108 is formed in the side wall of the enclosure 104 and is sized to receive the handle assembly 10 such that the majority of the handle assembly 10 is housed within the enclosure 104. The two electrical terminals 112 are configured to automatically separate when an overload of current or short circuit occurs through the two electrical terminals 112.

The handle assembly 10 includes the housing 14 and the handle 26 as shown in FIGS. 1-5, 8, and 10. The housing 14 may be formed of any rigid high-strength material that is capable of supporting the additional components of the handle assembly 10, such as plastics, polymers, or steel. In the illustrative embodiment, the housing 14 is comprised of metal, specifically thin metal plates arranged perpendicularly to one another, as shown in FIGS. 1 and 3-5. The housing 14 includes at least a front plate 15 and a side plate 16. The housing 14 may be mounted within the circuit breaker enclosure 104 via fasteners coupled between the side plate 16 and/or the front plate 15 and a mounting assembly (not shown) located within the enclosure 104. In other embodiments, the housing 14 may include additional side walls as necessary.

The front plate 15 includes the first aperture 18 through which the manually operable handle 26 extends. The handle assembly 10 includes an inner seal edge 22 that extends around the entire perimeter of the first aperture 18. The shroud 34 is arranged on the handle 26 so as to continuously engage the inner sealing edge 21 of the seal 22, which will be described in detail below. In the illustrative embodiment, inner side wall edges of first and second side walls 55, 56 of the seal 22 and inner end wall edges of first and second end walls 57, 58 of the seal 22 define the inner sealing edge 21 that engages the outer surface 38 of the shroud 34, which will be described in detail below. In other embodiments, the inner edge of the first aperture 18 may define the inner sealing edge 21.

The handle 26 extends through the first aperture 18 such that the handle 26 may be accessed by an operator in order to switch the circuit breaker 100 between at least an "ON", "OFF", and "TRIP" position. The handle 26 is pivotable about a pivot axis 30 located within the housing 14 and includes a handle arm 46 and an outer handle portion 50. The handle arm 46 is arranged within the housing 14 and has a first end 47 arranged within the housing 14 and a second end 48 located on an opposite end of the handle arm 46. The first end 47 is pivotably coupled to the housing 14 at a pivot point located on a pivot axis 30. The handle arm 46 is coupled to housing 14 via a rotatable fastener or the like. The handle arm 46 extends away from the pivot point towards the first aperture 18 and is attached to the outer handle portion 50 at the second end 48 of the handle arm 46.

Figure 3:
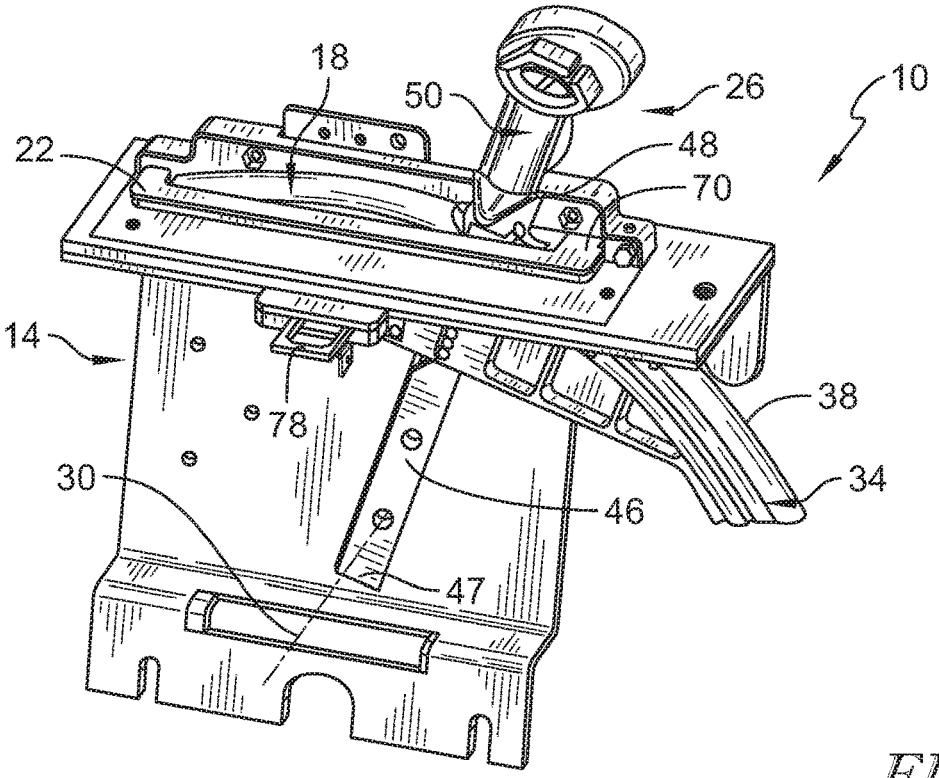
FIG. 3 is a side perspective view of the handle assembly of FIG. 1.
Figure 9A:
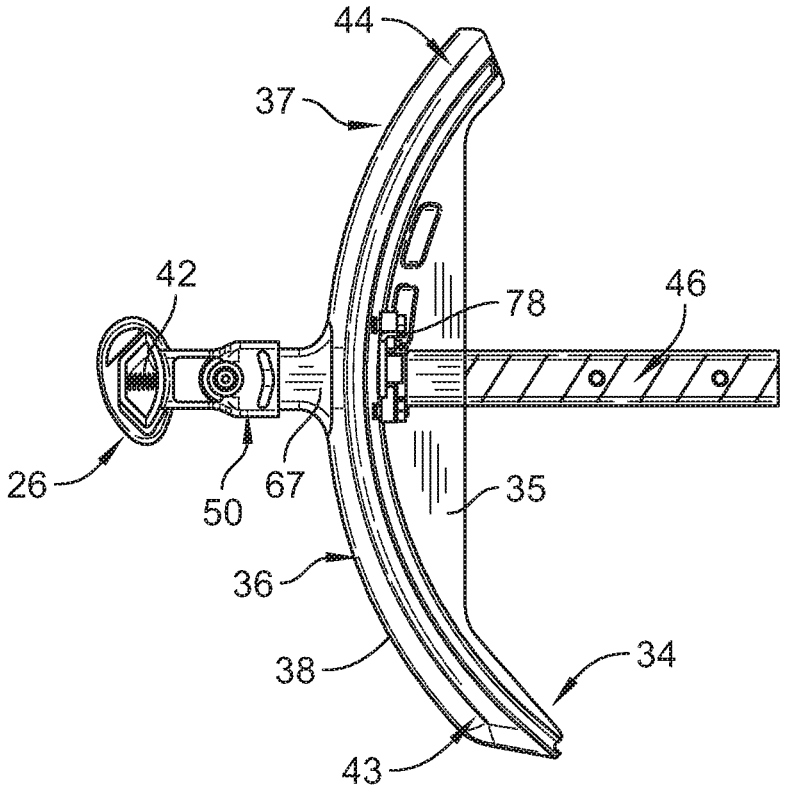
FIG. 9A is a side elevation view of a handle, a biasing member, and the shroud of the handle assembly of FIG. 1.
Figure 9B:
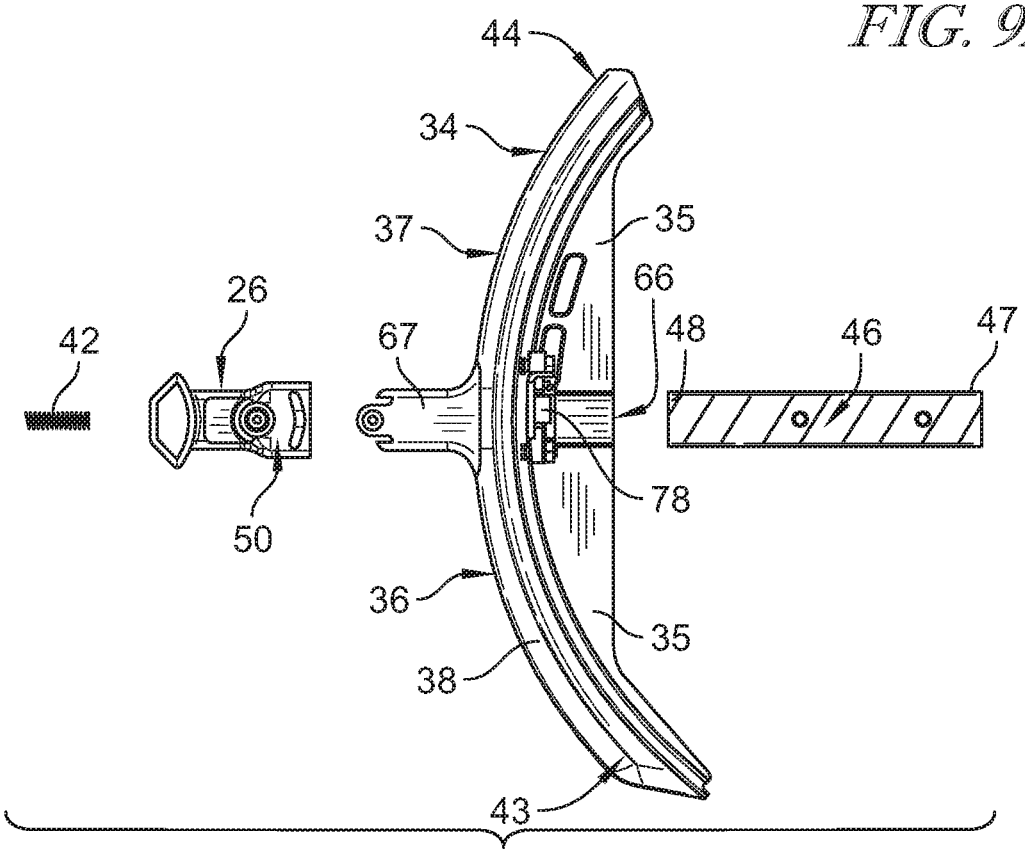
FIG. 9B is an exploded side elevation view of the handle, biasing member, and shroud of FIG. 9A.

The manually operable outer handle portion 50 is arranged on the second end 48 of the handle arm 46 and extends outwardly away from the second end 48. As can be seen in FIGS. 1 and 3, the outer handle portion 50 extends completely out of the first aperture 18 such that the outer handle portion 50 is exposed to the environment. The second end 48 of the handle arm 46 attaches to the handle portion 50 approximately at the location of the first aperture 18. The outer handle portion 50 further includes a handle knob 52 and an outer handle cover 53. The handle knob 52 is configured to be engaged by an operator so as to make manually movement of the handle 26 easier. The outer handle cover 53 is a hollow cover that covers an outer surface of an outer extension 67 of the shroud 34, as shown in FIGS. 9A and 9B.

The handle 26 is configured to pivot within a range that is delimited by the first aperture 18 as shown in FIGS. 1 and 3. For example, when viewing FIG. 1, the handle 26 may be moved upwardly until the outer handle portion 50, or the outer handle cover 53, or the outer extension 67 of the shroud 34 contacts an upper edge of the inner sealing edge 21 of the seal 22. Likewise, the handle 26 may be moved downwardly until the outer handle portion 50, or the outer handle cover 53, or the outer extension 67 of the shroud 34 contacts a bottom edge of the inner sealing edge 21 of the seal 22. In some embodiments, the handle assembly 10 may include additional components that further limit the pivotable movement of the handle 26.

In the illustrative embodiment, the shroud 34 is coupled to the handle 26 to move with the handle 26 as shown in FIGS. 1-5 and 8-10. In some embodiments, a majority of the shroud 34 is arranged to overlie the handle arm 46, while a smaller portion overlies the outer handle portion 50 such that the majority of the shroud 34 is concealed within the housing 14. In other embodiments, the shroud 34 may extend further outwardly relative to the handle 26 such that more of the shroud 34 is exposed to the environment.

The shroud 34 may be comprised of any suitable material that will keep dust, water, and other contaminants out of the interior of the housing 14 and the interior of the circuit breaker enclosure 104. In some embodiments, the shroud 34 is comprised of plastics or polymers. The shroud 34 may also be formed via injection molding, casting, 3D printing, CNC machining, or other similar processes.

Figure 5:
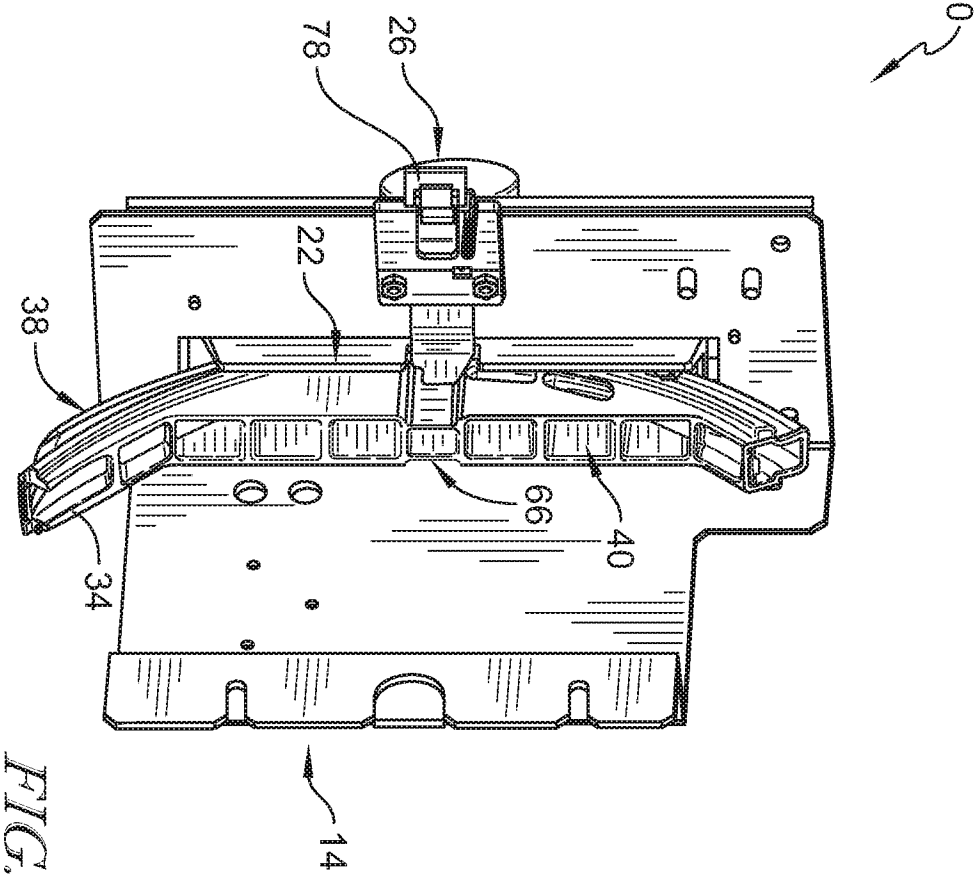
FIG. 5 is a rear perspective view of the handle assembly of FIG. 1.
Figure 6A:
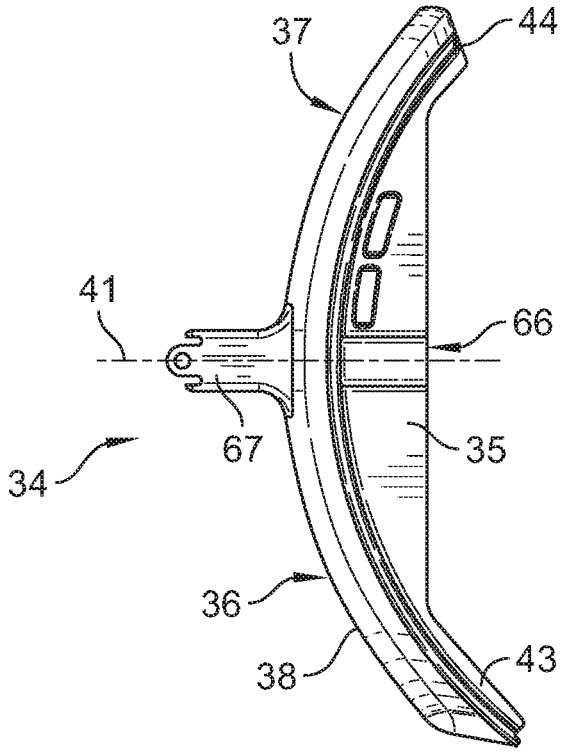
FIG. 6A is a side elevation view of a shroud of the handle assembly of FIG. 1.
Figure 6B:
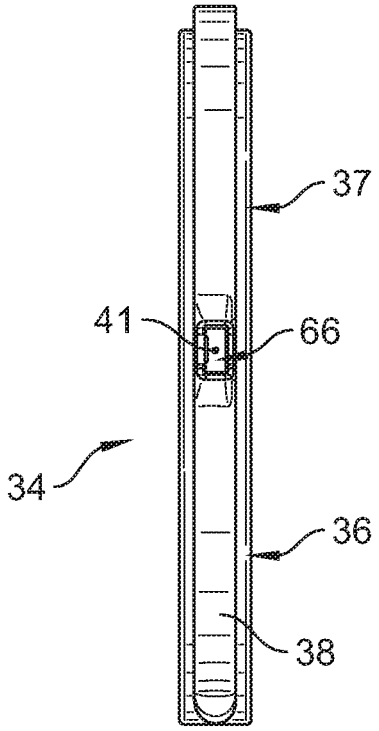
FIG. 6B is top view of the shroud of FIG. 6A.
Figure 6C:
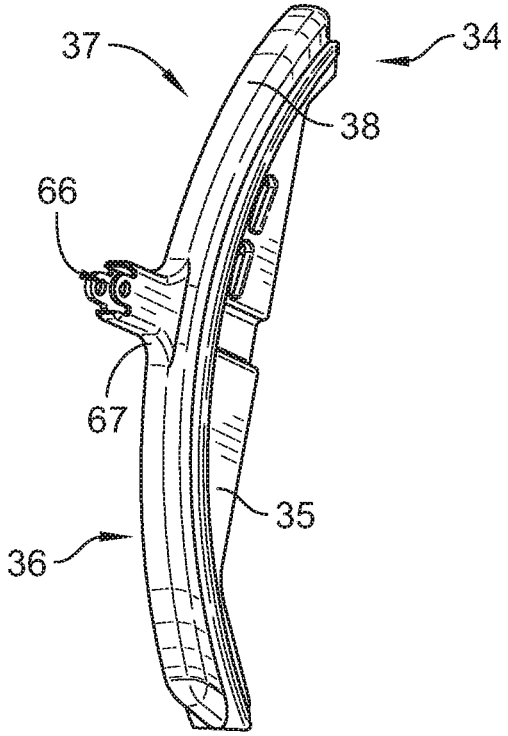
FIG. 6C is a side perspective view of the shroud of FIG. 6A.
Figure 7A:
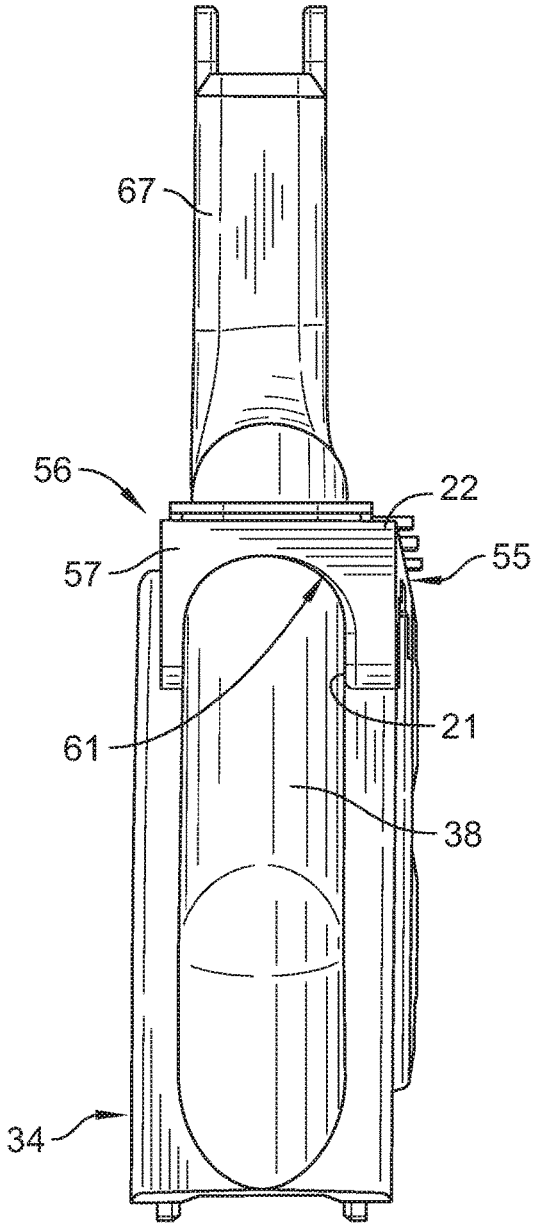
FIG. 7A is an end elevation view of a seal and the shroud of the handle assembly of FIG. 1.
Figure 7B:
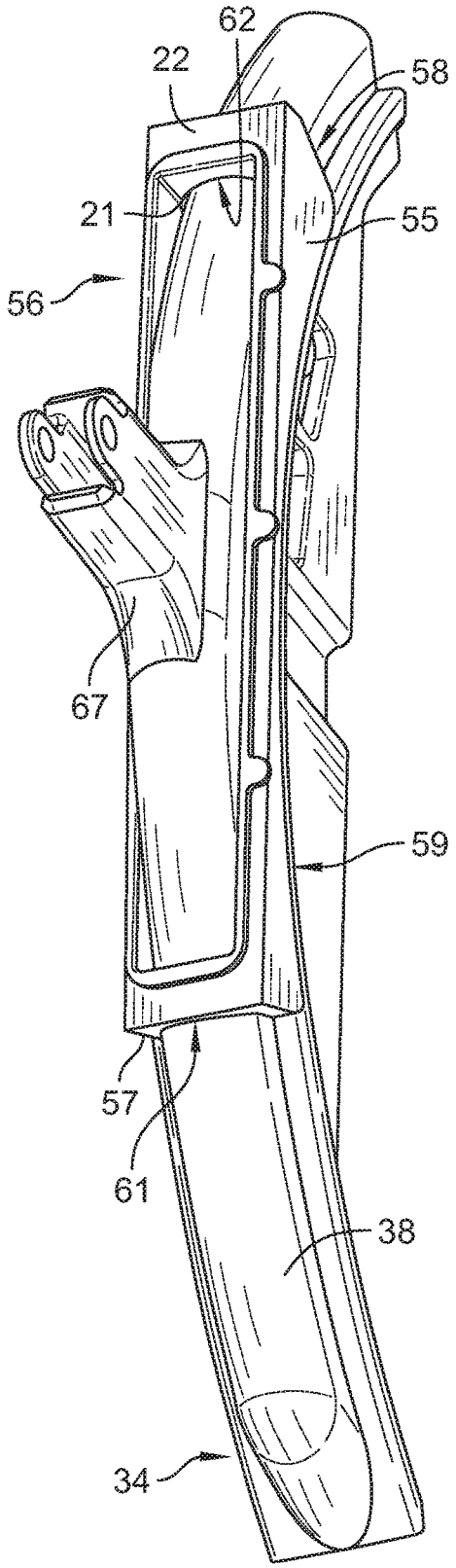
FIG. 7B is a front perspective view of the seal and the shroud of FIG. 7A.

As shown in FIGS. 1 and 3-5, and further detailed in FIGS. 6A-6C, the shroud 34 is formed as a semi-hollow piece having a curved outer surface 38 that, when coupled to the handle 26, faces outwardly away from the interior of the housing 14 towards the seal 22. As can be seen in FIGS. 5, 6A, and 6C, the shroud 34 includes a main body 35 having an arcuate or curved shape. In some embodiments, the shroud 34 is semi-circular. In the illustrative embodiment, a circumferential extent of the shroud 34 amounts to approximately a fifth of the circle. It can be envisioned that the circumferential extent of the shroud 34 may be smaller or greater depending on the needs of the particular application in which the shroud 34 is being used. Because of the circular shape of the shroud 34, at least a portion of the shroud 34 is consistently exposed outwardly of the inner sealing edge 21 of the seal 22.

The main body 35 of the shroud 34 is mostly arranged within the housing 14 when mounted on the handle 26. In the illustrative embodiment, the main body 35 is semi-hollow and has a plurality of chambers 40 in order to reduce the weight of the shroud 34, as shown in FIG. 5. In other embodiments, the main body 35 of the shroud 34 may be solid and not include the chambers 40, such as for applications requiring a more robust shroud 34. As shown in FIGS. 6A and 6C, the shroud 34 extends outwardly away from a central axis 41 of the shroud 34, and as such, the shroud 34 defines a first circumferential portion 36 that extends away from the central axis 41 in one direction, and a second circumferential portion 37 that extends away from the central axis 41 in the opposite direction. In the illustrative embodiment, the first and second circumferential portions 36, 37 are symmetrical. In other embodiments, the first and second circumferential portions 36, 37 are asymmetrical.

The shroud 34 further includes two wing portions 43, 44 that extend outwardly beyond the main body 35 in the circumferential direction as shown in FIGS. 6A and 6C. The two wings 43, 44 provide additional surface area of the outer surface 38 that may be necessary for the outer surface 38 to continuously touch the inner sealing edge 21 of the seal 22, as will be described in detail below. In the illustrative embodiment, the wings 43, 44 follow the curve of the outer portion of the main body 35 such that the outer surface 38 is perfectly annular. In particular, the outer surface 38, which extends over the entirety of the shroud 34, is concentric with the pivot axis 30 such that the curve of the outer surface 38 is equal to the curve of the pivoting movement of the handle 26. In other embodiments, the curve of the outer surface 38 does not match the curve of the pivotable movement of the handle 26, such as for a handle assembly 10 including a differently shaped inner sealing edge 21 or aperture 18.

The shroud 34 further includes a central hole 66 formed in the main body 35 coaxially with the central axis 41 as shown in FIGS. 6A-6C. The shroud 34 also includes the outer extension 67 extending outwardly away from the outer surface 38. The outer extension 67 is hollow and is coaxially with the central axis 41 and the central hole 66. The central hole 66 and the interior of the outer extension 67 are sized to generally conform to the outer profile of the handle arm 46 such that the shroud 34 may be arranged on and circumscribe the handle arm 46. In the illustrative embodiment, the shroud 34 is configured to slide along the handle arm 46 so that the shroud 34 can be pulled toward the outer end of the handle 26 and into continuous engagement with the inner sealing edge 21 of the seal 22 by the biasing member 42, which will be described in detail below. In other embodiments, the shroud 34 may be rigidly coupled to the handle 26.

In the illustrative embodiment, the shroud 34, including the main body 35 and the wings 43, 44, has a large enough circumferential extent such that, when the shroud 34 is in a centered position (as shown, for example, in FIGS. 1 and 10) the outer surface 38 extends beyond the boundary of the inner sealing edge 21 and into the interior of the housing 14. In particular, the circumferential extent of the outer surface 38 is large enough such that, when the handle 26 is fully pivoted upwardly or downwardly, at least a portion of the outer surface 38 remains in contact with the inner sealing edge 21. For example, with reference to FIG. 1, when the handle 26 is moved upwardly until the handle 26 or the shroud 34 contacts an inner edge of the seal 22, at least a lower portion of the outer surface 38 remains in contact with seal 22, so as to continuously seal off the interior of the housing 14.

As can be seen in FIGS. 1 and 6A-10, the outer surface 38 has a smooth, curved cross-sectional shape along the circumferential extent of the outer surface 38. The curved cross-sectional shape matches a curved contour of a first end wall 57 and a second end wall 58 of the seal 22, which will be described in detail below. The matching contours allow for at least a portion of the outer surface 38 to continuously contact the first and second end walls 57, 58 of the seal 22 throughout the entirety of the pivotable range of the handle 26. In other embodiments, the outer surface 38 may include a cross-section having a different curve than the curve shown in FIGS. 1 and 6A-10, and may be flat in some embodiments.

In order to cause the outer surface 38 of the shroud 34 to continuously engage the inner sealing edge 21 of the seal 22, the handle assembly 10 further includes the biasing member 42 configured to pull the shroud 34 towards the outer end of the handle 26, as shown in detail in FIGS. 4, 9A, and 9B. In the illustrative embodiment, the biasing member 42 is a pressure spring that exerts a force capable of holding the shroud 34 in continuous engagement with the inner sealing edge 21 of the seal 22. A stronger or weaker pressure spring may be used in other embodiments based on the specific requirements of the particular application in which the handle assembly 10 is being used. In other embodiments, the biasing member 42 may be any other type of resilient mechanism, so long as the biasing member 42 is capable of holding the shroud 34 in continuous engagement with the inner sealing edge 21 of the seal 22.

As can be seen in FIG. 4, the outer handle portion 50 includes a cavity within the handle portion 50 in which the biasing member 42 is arranged. As such, the biasing member 42 is located entirely within the outer handle portion 50 and is not exposed to the environment, thus elongating the life of the biasing member 42 and as such the handle assembly 10. A first end of the biasing member 42 is coupled to an inner top portion of the cavity formed in the outer handle portion 50 and a second end of the biasing member 42 is coupled to a top portion of the shroud 34. In the illustrative embodiment, the biasing member 42 extends slightly into the outer extension 67 of the shroud 34 and is coupled therein. In other embodiments, the biasing member 42 may extend further into the shroud 34 and couple thereto. In other embodiments, the outer handle portion 50 only includes the outer handle cover 53, and the biasing member 42 is arranged within the outer handle cover and is connected to an inner top portion of the outer handle cover 53.

As discussed above, the seal 22 is arranged within the first aperture 18 and includes a first side wall 55, a second side wall 56, a first end wall 57, and a second end wall 58 which each project inwardly toward the outer surface 38. The first side wall 55 and the second side wall 56 each include an inner side wall edge 59, 60 that has the same contour as a circumferential contour of the outer surface 38. In other words, the radius of curvature of the inner side wall edges 59, 60 matches the radius of curvature of the outer surface 38. Likewise, the first end wall 57 and the second end wall 58 each include an inner end wall edge 61, 62 that has the same contour as the curved cross-sectional shape of the outer surface 38. The inner side wall edges 59, 60 of the first side wall 55 and the second side wall 56, and the inner end wall edges 61, 62 of the first end wall 57 and the second end wall 58 define the inner sealing edge 21 of the seal 22.

Figure 11:
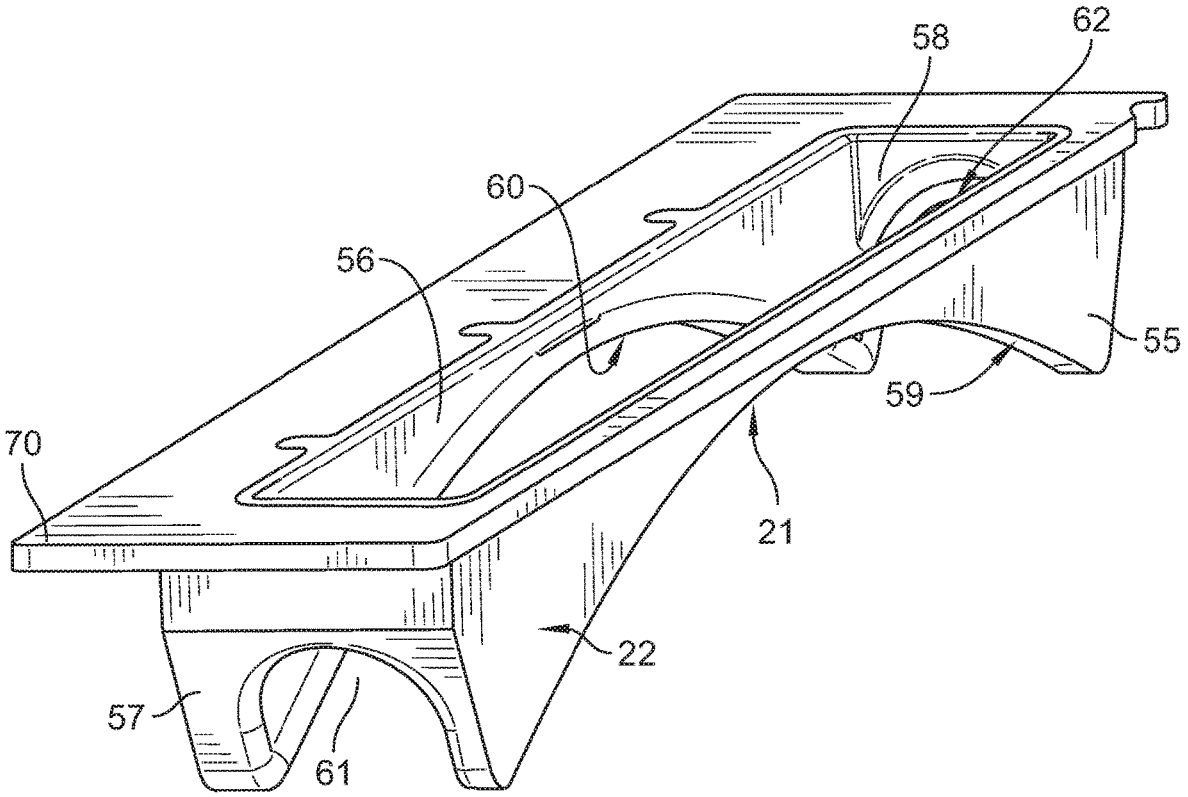
FIG. 11 is a perspective view of the seal of FIG. 7A.

The seal 22 may be formed of a rubber-like material so as to remain in sealing contact with the outer surface 38 of the shroud 34 in the event of any imperfections in the pivoting of the handle 26. The seal 22 may further include an outer platform 70 as shown in FIG. 11. The outer platform 70 may be formed of hard-plastic and, in some embodiments, is molded onto the seal 22. The handle assembly 10 may further include an escutcheon 74 arranged over the front plate 15 so as to cover a majority of the outer platform 70 and including an aperture that substantially matches the size of the first aperture 18. The escutcheon 74 may also include an indicator strip 86 configured to align with an indicator extension 82 extending away from the outer handle portion 50. In the illustrative embodiment, the indicator strip 86 includes the markings "ON", "OFF", AND "TRIP" that indicate whether the circuit breaker 100 is in one of these modes. The indicator extension 82 moves with the handle 26 and, as such, points to which of the "ON", "OFF", AND "TRIP" modes in which the handle 26 has put the circuit breaker 100.

In operation, the handle 26 may begin in the central "TRIP" position. The shroud 34 is in contact with the inner sealing edge 21 defined by the walls 55, 56, 57, 58 of the seal 22 and is being pulled toward the outer end of the handle 26 by the biasing member 42. An operator may then grasp the outer handle portion 50, in particular the handle knob 52, and move the handle 26 to either the "ON" position or the "OFF" position so as to put the circuit breaker 100 in that mode. As the operator moves the handle 26, the outer surface 38 of the shroud 34 remains in continuous contact (engagement) with the inner sealing edge 21 because of the outer curved shape of the shroud 34 and because of the biasing member 42 pulling on the shroud 34.

In some embodiments, the handle assembly 10 may further include a lockout extension 78 as shown in FIGS. 1, 5, 8, and 10. The lockout extension 78 is arranged on a side of the front plate 15 opposite the side plate 16 and extends inwardly toward the shroud 34. As can be seen in FIG. 5, the lockout extension 78 extends into a recess formed in the side of the main body 35 of the shroud 34. As such, when the lockout extension is engaged (pushed inward and into the recess), the handle 26 is prevented from moving. This is useful for situations in which moving the handle 26 is undesirable, such as when maintenance is being performed on the circuit breaker 100. In other embodiments, the lockout extension 78 may be arranged elsewhere on the housing 14 so long as the lockout extension 78 is capable of locking the handle 26 and shroud 34 in place.

Figure 8:
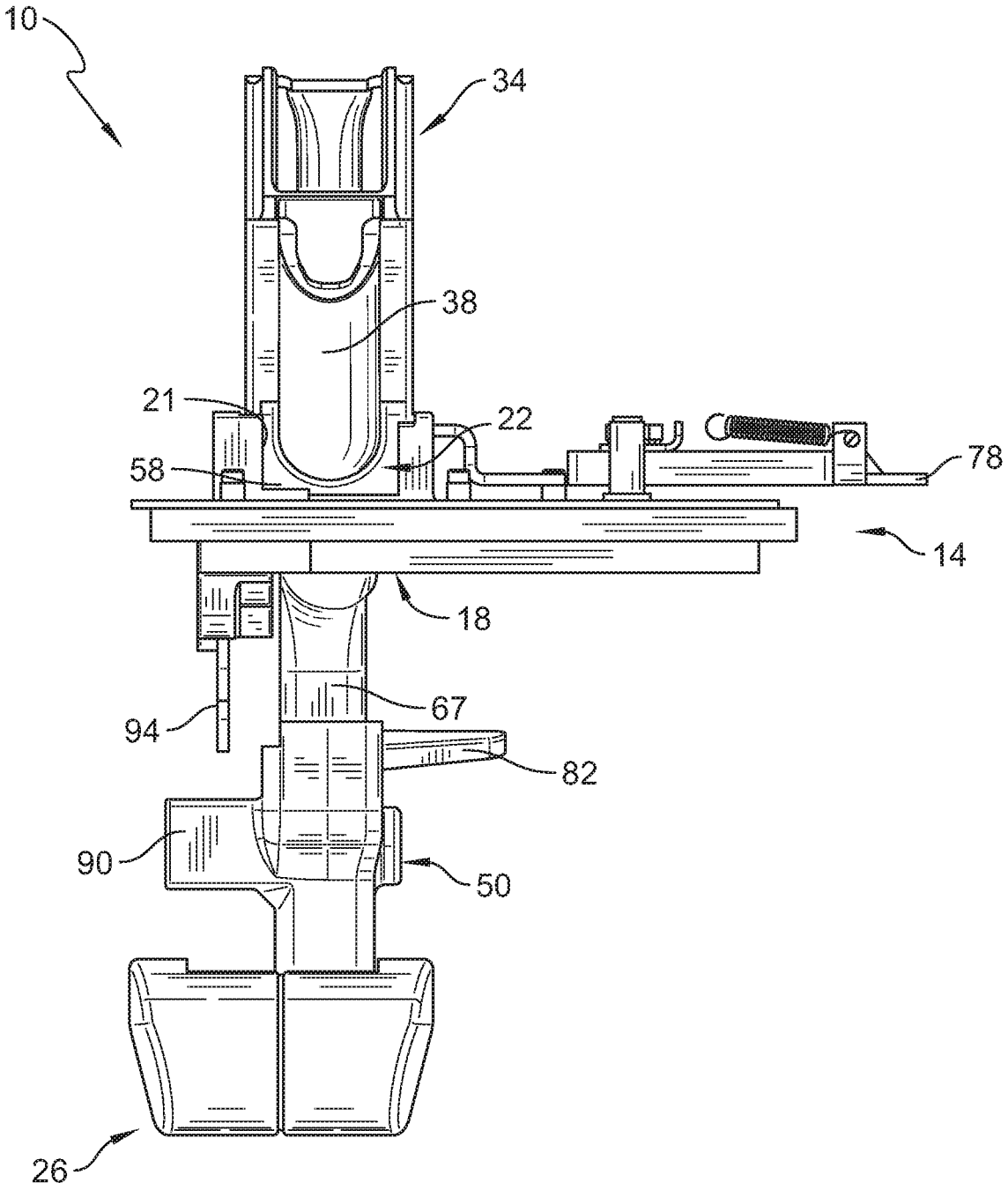
FIG. 8 is a top view of the handle assembly of FIG. 1.
Figure 10:
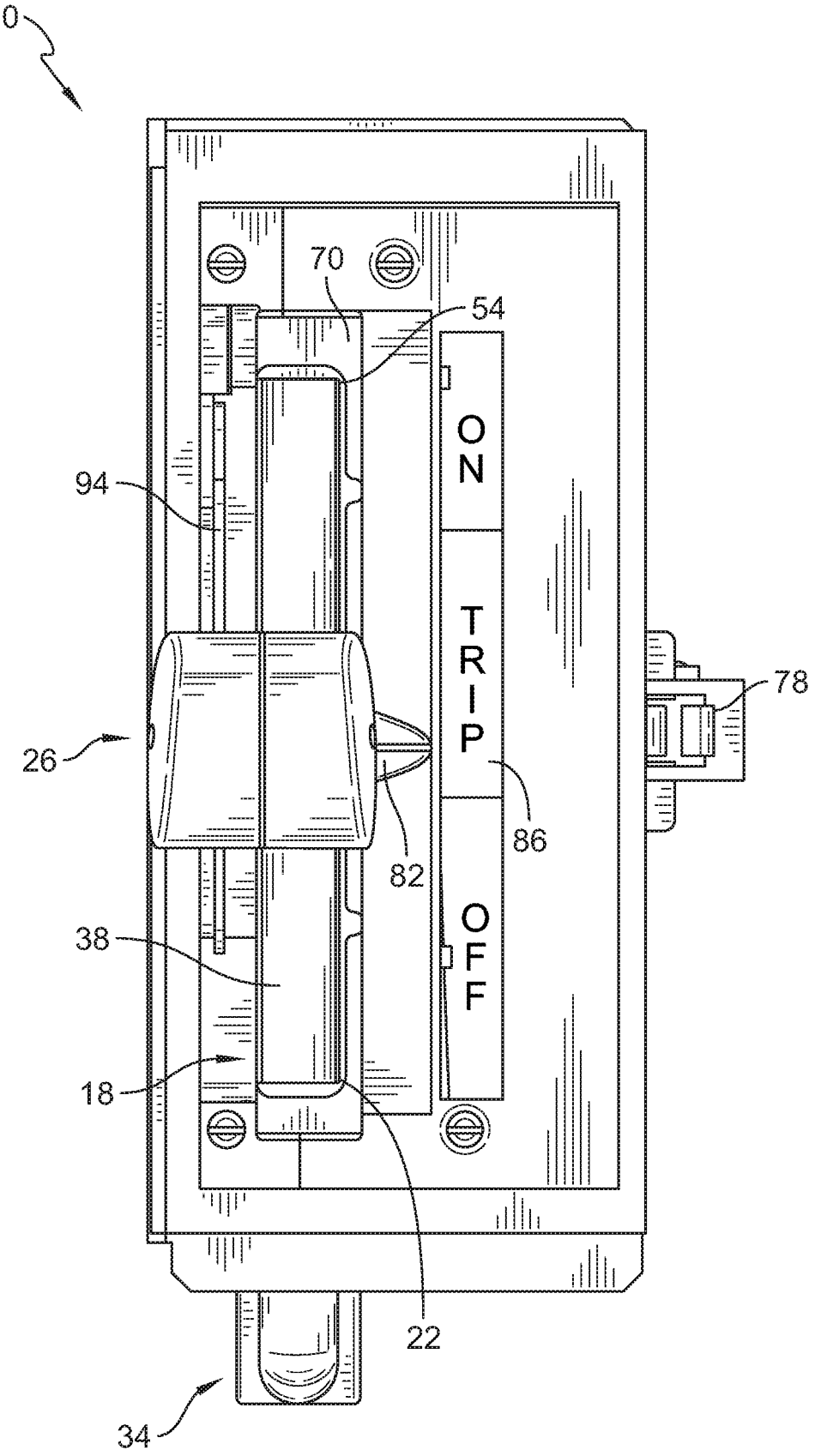
FIG. 10 is a front elevation view of the handle assembly of FIG. 1.

In some embodiments, the handle 26 of the handle assembly 10 may further include a safety stop 90 extending away from the outer handle portion 50 as shown in FIGS. 1, 8, and 10. The safety stop 90 is configured to interact with a removable plate 94 attached to the side plate 16 of the housing. When the removable plate 94 is in a desired position, the safety stop 90 of the handle 26 will contact the removable plate 94 if any attempt at moving the handle 26 is made. This, again, is useful for situations in which moving the handle 26 is undesirable, such as when maintenance is being performed on the circuit breaker 100.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present invention and fall within the spirit and scope of the present disclosure as defined by the appended claims.

The invention claimed is:

1. A handle assembly comprising:

a housing defining a first aperture;

a seal extending around a perimeter of the first aperture;

a handle extending outwardly through the first aperture and pivotable about a pivot axis located within the housing;

a shroud slidably coupled to the handle to move therewith and located at least partially within the housing, the shroud including an outer surface that faces the seal; and a biasing member connected to the handle and to the shroud, the biasing member biasing the outer surface into continuous engagement with the seal throughout an entire pivotable range of the handle by exerting a pulling force on both the handle and the shroud such that the shroud is biased towards the seal.

2. The handle assembly of claim 1, wherein the handle comprises:

a handle arm arranged at least partially within the housing, the handle arm having a first end coupled to the housing at a pivot point located on the pivot axis and a second end located opposite the first end; and a manually operable outer handle portion arranged on the second end of the handle arm.

3. The handle assembly of claim 2, wherein the shroud is arranged on the handle arm and is slidable along a longitudinal extent of the handle arm, and wherein the biasing member is arranged within the outer handle portion and is coupled to the shroud to bias the shroud toward the outer handle portion.

4. The handle assembly of claim 3, wherein the second end of the handle arm is arranged outside of the housing, and wherein the shroud is arranged on the handle arm such that at least a portion of the shroud protrudes out of the first aperture.

5. The handle assembly of claim 4, wherein the outer surface of the shroud has an arcuate shape, and wherein a circumferential extent of the outer surface is located partially within the housing.

6. The handle assembly of claim 5, wherein the arcuate shape of the outer surface is concentric with the pivot axis, and wherein the outer surface includes a first circumferential portion and a second circumferential portion extending in opposite directions away from the handle arm.

7. The handle assembly of claim 6, wherein the first circumferential portion and the second circumferential portion are symmetrical.

8. The handle assembly of claim 6, wherein the outer surface has a curved cross-sectional shape.

9. The handle assembly of claim 8, wherein the seal includes a first side wall, a second side wall, a first end wall, and a second end wall each projecting inwardly toward the outer surface, wherein the first side wall and the second side wall each include an inner side wall edge that has the same contour as the arcuate shape of the outer surface, and wherein the first end wall and the second end wall each include an inner end wall edge that has the same contour as the curved cross-sectional shape of the outer surface.

10. The handle assembly of claim 9, wherein (i) the inner side wall edges of the first and second side walls and (ii) the inner end wall edges of the first and second end walls define an inner sealing edge that engages the outer surface of the shroud.

11. The handle assembly of claim 3, wherein the outer handle portion is hollow, wherein the biasing member is disposed entirely within the outer handle portion, wherein a first end of the biasing member is coupled to a top portion of the outer handle portion, and wherein a second end of the biasing member is coupled to a top portion of the seal.

12. The handle assembly of claim 3, wherein the biasing member is a pressure spring.

13. The handle assembly of claim 3, wherein the shroud includes a central hole through which the handle arm extends to allow the shroud to slide along the handle arm.

14. A circuit breaker comprising:

a circuit breaker case;

at least two electrical terminals configured to automatically separate when an overload of current occurs at the at least two electrical terminals;

a handle assembly arranged at least partially within the circuit breaker case and including a handle configured to manually operate the at least two electrical terminals, the handle assembly comprising:

a housing defining a first aperture, the housing having seal extending around a perimeter of the first aperture, the handle extending outwardly through the first aperture and pivotable about a pivot axis located within the housing, a pivotable range of the handle being delimited by the first aperture;

a shroud slidably coupled to the handle to move therewith and located partially within the housing, the shroud including an outer surface that faces the seal; and a biasing member connected to the handle and to the shroud, the biasing member biasing the outer surface into continuous engagement with the seal throughout an entirety of the pivotable range of the handle by exerting a pulling force on both the handle and the shroud such that the shroud is biased towards the seal.

15. The circuit breaker of claim 14, wherein the handle comprises:

a handle arm arranged at least partially within the housing and having a first end coupled to the housing at a pivot point located on the pivot axis and a second end located opposite the first end; and a manually operable outer handle portion arranged on the second end of the handle arm.

16. The circuit breaker of claim 15, wherein the shroud is arranged on the handle arm and is slidable along a longitudinal extent of the handle arm, and wherein the biasing member is arranged within the outer handle portion and is coupled to the shroud to bias the shroud toward the outer handle portion.

17. The circuit breaker of claim 16, wherein the shroud is arranged on the handle arm such that at least a portion of the shroud protrudes out of the first aperture.

18. The circuit breaker of claim 17, wherein the outer surface of the shroud is arcuate, and wherein a circumferential extent of the outer surface is located partially within the housing.

19. The circuit breaker of claim 18, wherein the outer surface is concentric with the pivot axis, and wherein the outer surface includes a first circumferential portion and a second circumferential portion extending in opposite directions away from the handle arm.

20. The handle assembly of claim 16, wherein the outer handle portion is hollow, wherein the biasing member is disposed entirely within the outer handle portion, wherein a first end of the biasing member is coupled to a top portion of the outer handle portion, and wherein a second end of the biasing member is coupled to a top portion of the shroud.

* * * * *